US005440852A

United States Patent [19]

Lam

[11] Patent Number: 5,440,852

[45] Date of Patent: Aug. 15, 1995

[54] FLAP FOLDER

[75] Inventor: Joe A. S. Lam, Richmond, Canada

[73] Assignee: Belcor Industries Inc., Richmond, Canada

[21] Appl. No.: 94,730

[22] Filed: Jul. 21, 1993

[51] Int. Cl.[6] ..... B65B 7/20; B65B 7/26

[52] U.S. Cl. ..... 53/377.2

[58] Field of Search ..... 53/376.2, 376.3, 376.4, 53/376.5, 376.7, 377.2, 377.8; 493/177, 183

[56] References Cited

U.S. PATENT DOCUMENTS

| | | | |
|---|---|---|---|
| 3,426,506 | 2/1969 | Jernigan | 53/376.7 |
| 4,161,138 | 7/1979 | Marchetti . | |
| 4,671,046 | 6/1987 | Lewis et al. | 53/376.5 |
| 4,748,794 | 6/1988 | Marchetti | 53/376.4 |

*Primary Examiner*—Horace M. Culver
*Assistant Examiner*—Rodney A. Butler
*Attorney, Agent, or Firm*—C. A. Rowley

[57] ABSTRACT

A flap folder is formed by a pair of parallel rails which define a carton package there between. Each of the rails mounts for relative reciprocal motion a control rod on each of which is mounted a flap folding lever positioned to cooperate with a cam on its adjacent rail to move the lever into a flap folding extended position and return it to a retracted position when the bar is moved relative to the rail. A side flap folding plough is mounted on each of the rail at the downstream end thereof and is formed with a cam surface that cooperates with a cam mounted on its adjacent bar. After the lever has folded the rear flap each plough is moved from a retracted position to an extended position by the movement of the bar relative to the rail. Similarly, a stop mechanism is mounted on the rail and is movable to an extended position stopping movement of a carton into the passage by movement of the bar from its starting position and to a retracted position when the bar return to its initial position. Preferably, the conveyor for moving the carton through the folder is a chain drive wherein a pair of sprocket are adjacent one side of the machine on opposite sides of a line or projection thereof interconnecting the axis of two driven sprockets and wherein a chain wraps the sprockets in a manner to form the chain into a pair of internested U shapes.

18 Claims, 5 Drawing Sheets

FLAP FOLDER

FIELD OF THE INVENTION

The present invention relates to a flap folder, more particularly, the present invention relates to a flap folder wherein movement of the folding instrumentalities is obtained by a reciprocal movement of a bar.

BACKGROUND OF THE PRESENT INVENTION

There are many different folding devices using cams, levers, ploughs and other such mechanisms to fold the flaps of a carton from an open position to a close position and to, if desired, seal the carton, for example, by preapplied adhesive or by tapes applied over the close flaps. Most of these devices include a movable plough position on the path of movement of the carton being closed and activated either pneumatically or electrically or hydraulically to force the plough in a looping action moving faster than the transported carton to fold the rear flap forwardly into a position substantially perpendicular to the rear wall. At about the same time a fixed front plough folds the front flaps substantially perpendicular to the front wall by movement of the carton relative to the plough. After the front and rear flaps have been folded the carton generally moves to another position wherein ploughs engage each of the side flaps and folds them over onto the prefolded front and rear flaps to close the carton. It will be apparent that the front and rear flaps must be folded before folding of the side flaps may begin, therefore, the carton must move along a relatively long path past stationary ploughs during the closing operation thereby requiring a relatively large piece of equipment.

In some closing systems, relatively complicated controls are required to actuate and time the actuation of the various stops, ploughs, and levers, etc.

In some of these devices, side conveyors (i.e. conveyors positioned on each side of the carton passage and that grip (by friction) each side of the carton) are used to move the carton through the passage. It will apparent that the direction movement of the conveyor belt on one side of the passage is in one direction and of the belt on the other side is in the opposite direction, i.e. the drive roller on one side of the carton passage rotates in the clockwise direction while the one on the other side rotates in the counterclockwise direction. A suitable drive for such a belt conveyor system is shown in U.S. Pat. No. 4,161,138 issued Jul. 17, 1979 to Marchetti. This drive requires that the width of the machine be extended, which obviously detracts significantly from the compactness of the equipment and is a detriment when space requirements are the premium.

BRIEF DESCRIPTION OF THE PRESENT INVENTION

It is an object of the present invention to provide a simplified folding mechanism for closing a carton by folding the rear and side flaps and including a stop mechanism to properly space or time the feeding of cartons into the equipment.

It is a further object of the present invention to provide an improved means for driving side conveyors for moving the cartons through the folding passage of the folding equipment.

Broadly, the present invention relates to a flap folder comprising a pair of spaced parallel rails, a carton passage between said rails, a control bar mounted on each of said rails for axial movement relative to its respective rail, means for moving said bars in a first direction downstream of the direction of movement of a carton along said passage during a flap folding operation and then in a second direction opposite to said first direction, a pair of flap folding levers, each of said flap folding levers having a cam means, one of said flap folding levers being mounted on each of said bars, a pair of first cooperating cam means one of said cooperating cam means being fixed to each of said rails in a position to engage its adjacent said first cam means when said bars and said levers are moved in said first direction relative to their respective adjacent said rails to move each of said levers from a retracted position to a flap folding position and maintain said levers in said folding positions during further movement of said bars in said first direction, and to return said levers to said retracted positions when said bars and said levers are moved relative to their respective said rails in said second direction opposite to said first direction.

Preferably, said flap folder will further comprise a pair of ploughs, one of said ploughs pivotably mounted on each of said rails downstream relative to said lever in said first direction, a pair of second cams mounted one on each of said bars, a pair of second cooperating cam means one on each of said ploughs, each said second cam means being in a position to engage said second cooperating cam means on its respective adjacent said plough to move its respective adjacent said plough from a retracted to an extended folding position when said bars are moved in said first direction, but after said levers have been moved to said flap folding position, and to permit each said plough to return to its said retracted position when said bars are moved in said second direction.

Preferably, said flap folder will further include a pair of stop levers, one of said stop levers pivotably mounted on each of said rails, a pair of third cam means one mounted on each of said bars, each said third cam means cooperating with its adjacent stop lever to move its said adjacent stop lever to an extended position when its respective said bar is moved in the said first direction and maintain said stop lever in said extended position and to retract said stop lever when its respective said bar is moved in said second direction to the end of its path of travel in said second direction.

Preferably, said flap folder will further include a pair of conveyors, one on each side of said passage, drive means to drive said conveyors in synchronism to engage and move a carton along said passage in said first direction.

Preferably, said drive means will comprise a driven wheel for driving each of said conveyors, a pair of guiding wheels mounted adjacent to one of said driven wheels on the side of said one of said driven wheels remote from the other of said driven wheels, a drive belt, means to drive said belt, said drive belt encircling said wheels to rotate said driven wheels in opposite directions when driven by said drive belt and wherein a line connecting the rotational axis of said driven wheels (or an extension thereof) passes between said pair of guiding wheels.

Preferably, said means to drive said belt includes one of said guiding wheels.

Preferably, said drive belt passes from one of said guiding wheels to said other of said driven wheels around the other said guide wheels then around said one of said driven wheels and to said one of said guide wheels.

Preferably, said belt means will comprise a chain and said driven wheels are guide wheels will comprise sprockets.

BRIEF DESCRIPTION OF THE DRAWINGS

Further features, objects and advantages will be evident from the following detailed description of the preferred embodiments of the present invention taken in conjunction with the accompanying drawings in which.

DESCRIPTION OF THE PREFERRED EMBODIMENTS

Figure 1:
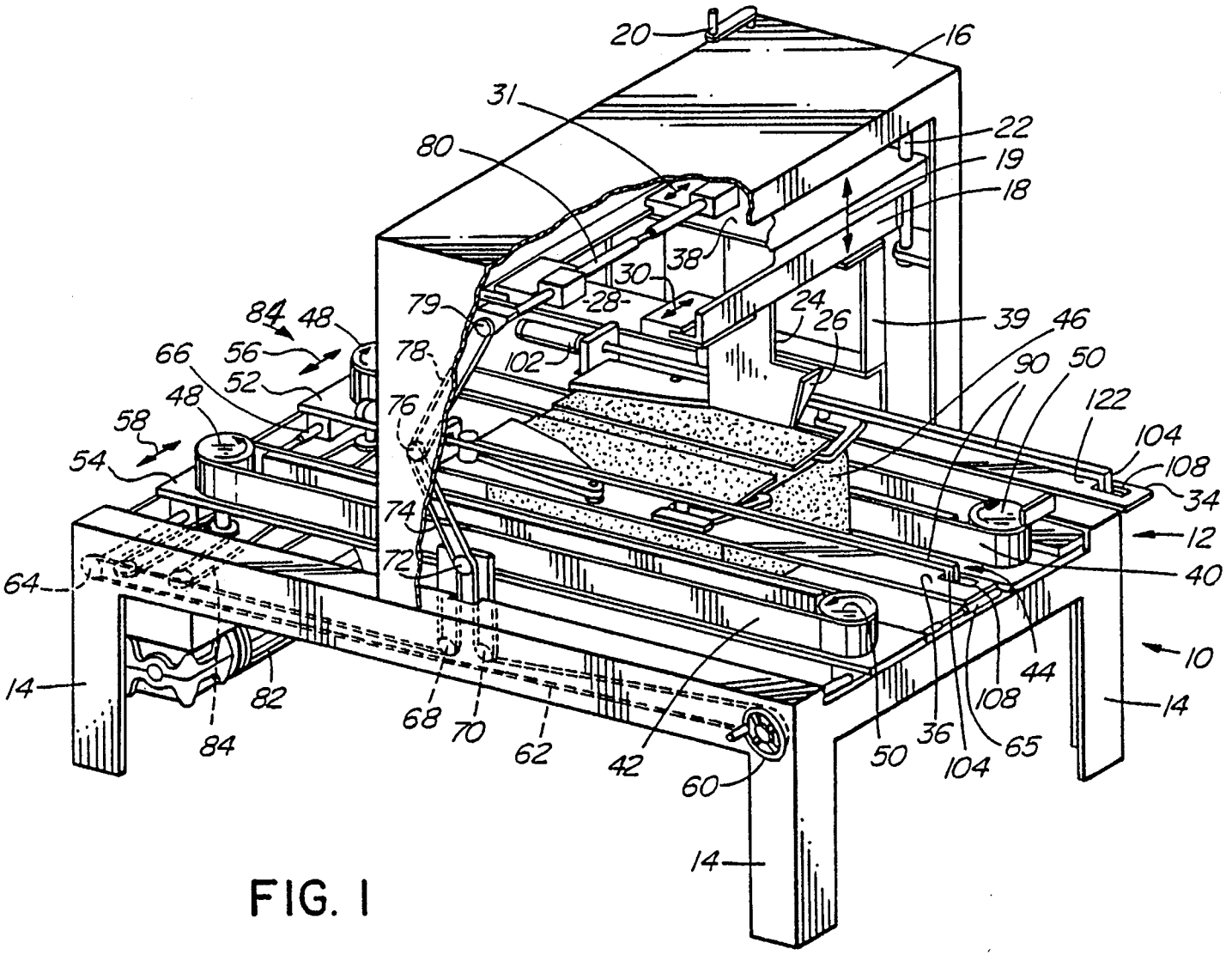
FIG. 1 is an isometric illustration with parts omitted showing one form of the present invention.

The flap folder or carton closing mechanism 10 of the present invention is mounted on a table 12 having legs 14. Positioned above the table 12 is an upper housing 16 to which a vertically adjustable platform 18 is mounted. The height of platform 18 relative to the table 12 is vertically adjusted by a suitable mechanism (not shown) but includes a hand wheel 20 and guide rods 22 each of which may be the worm part of worm drives driven by rotation of the hand wheel 20, there being one of the guide rods 22 for each corner of the platform 18.

Suspended from the platform 18 via a bar 24 is a front plough or shoe 26 (shown in raised position for clarity) for folding the front flap of a carton into a position perpendicular to the carton front wall as will be described below.

Also suspended below the platform 18 via suitable supports 39 (only one shown) are a pair of side rails 34 and 36 which mounts the stops, the closing levers and the ploughs and their control bars which form important parts of the present invention.

The rail 34 is suspended from a platform slide 38 via a suspension beam 39 while the rail 36 is supported from slide 28 through a similar suspension beam (not shown). Mounting slides 28 and 38 are supported on platform 18 in bearings that permit the slides 28 and 38 to a slide laterally of the platform 18 as indicated by the arrows 30 and 31 toward and away from each other to change the width or spacing between the rail 34 and 36.

Mounted on the table 12 is a conveyor system 84 formed by a pair of conveyor belts 40 and 42 which in the illustrated arrangement define opposite sides of the carton passage 44 along which the package or carton such as the carton 46 is moved via the belts 40 and 42 during the closing operation.

Each of the belts 40 and 42 wraps around its respective leading drive drum 48 (downstream drum) and trailing drum (idler) 50. The driven drums 48 are rotated in opposite directions, i.e. the drum 48 driving the belt 40 in clockwise direction whereas the drum 48 driving the belt 42 rotates in a counterclockwise direction. The belt drive, belt 40 and 42, and their respective drums 48 and 50 are mounted with the belt 40 and its drums on movable platform 52 and the belt 42 and its respective drum on the platform 54. These platforms 52 and 54 are relatively moveable toward and away from each other as indicated by the arrows 56 and 58.

These platforms 52 and 54 are movable toward and away from each other as indicated by the arrows 56 and 58 at the same time as the rails 34 and 36 are moved and by the same amount to widen and close the passage 44 to accommodate different width cartons 46.

The mechanism for adjusting the width of passage 44 including the spacing of the rails 34 and 36 and platforms 52 and 54 includes a hand wheel 60 which is directly connected to a first worm drive 65 connected to move the upstream ends of the platforms 52 which is connected via chain 62 and driven sprocket 64 to drive a second worm drive 66 connected to move the downstream ends of the platforms 52 and 54 so that the platforms 52 and 54 are moved towards or away from each other depending on the direction of rotation of the hand wheel 60. The chain 62 also passes around sprockets 68 and 70 and drives a sprocket (not shown) which in turn drives a sprocket 72 that drives a chain drive 74 which through sprocket 76 drives a second chain drive 78. The second chain drive 78 in turn drives via sprocket 79 a worm drive 80 similar to the worm drive 66 but which is connected to the slides 38 and 28 to move them as indicated by the arrows 30 and 31 either toward or away from each other in synchronism with the movement of the platforms 52 and 54.

It will be apparent that the structure of the chain drives 74 and 78 are such that the sprocket 76 is spaced from the sprockets 72 and 79 via suitable linkages that pivot on the axis of the sprockets 72, 76 and 79 to accommodate up and down movement of the platform 18 by the degree of bending at the sprocket 76.

The conveyors 40 and 42 are driven by a suitable drive motor 80 via a chain drive 84 as will be described below.

Figure 2A:
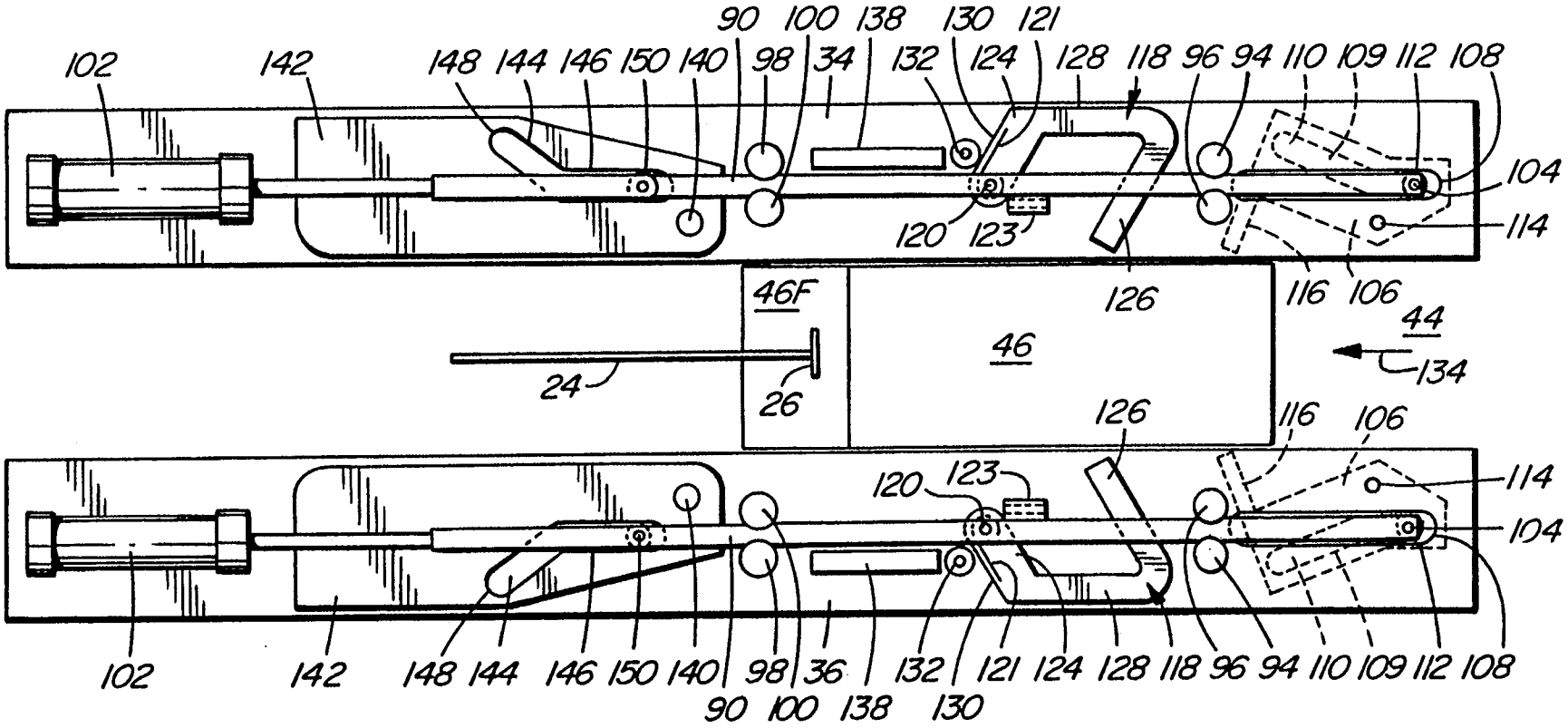
FIGS. 2A, 2B, and 2C are plan views illustrating the sequence of operation of the various folding elements as the control bars are advanced in the downstream direction of movement of the cartons to complete the folding flaps of a carton.

Referring now to FIG. 2A, the two platforms or rails 34 and 36 are essentially the same, one being basically a mirror image of the other and thus, only one of these devices will be described, in particular, the mechanisms on rail 34.

As shown, a control bar 90 is mounted on the rail 34 for receptacle movement as indicated by the arrow 92 parallel to the rail 36 and to the longitudinal axis of the passage 44 in a first direction downstream in the direction of movement of a carton along the passage 44 during the flap closing operation and then in a second direction opposite to said first direction. The mounting of the bar 90 is by pairs of opposed grooved roll 94 and 96, 98 and 100 which engage opposite sides of the bar 90 at axially spaced locations along the bar 90 to support the bar 90 for receptacle motion substantially along a straight line.

Motion is imparted to the bar 90 via a suitable pneumatic or hydraulic or any other suitable actuator as indicated at 102.

The actuation of the actuator 102 on each of the rails 34 and 36 is controlled by a suitable switch (not shown).

At the end of the bar 90 remote from the actuator 102 is a lateral (downward) projection 104 which functions as a cam to operate the stop lever 106 (see FIGS. 1 and 2). The cam projection 104 projects through an aperture 108 through the top surface of the rail 34 (or 36).

The stop lever 106 has a bent cam slot 109 formed by arm sections 110 and 112 intersecting at an acute angle. Each lever 106 is mounted on its respect rail 34 or 36 via a pivot pin 114 positioned adjacent to the intersection of the two arms 110 and 112.

Figure 2B:
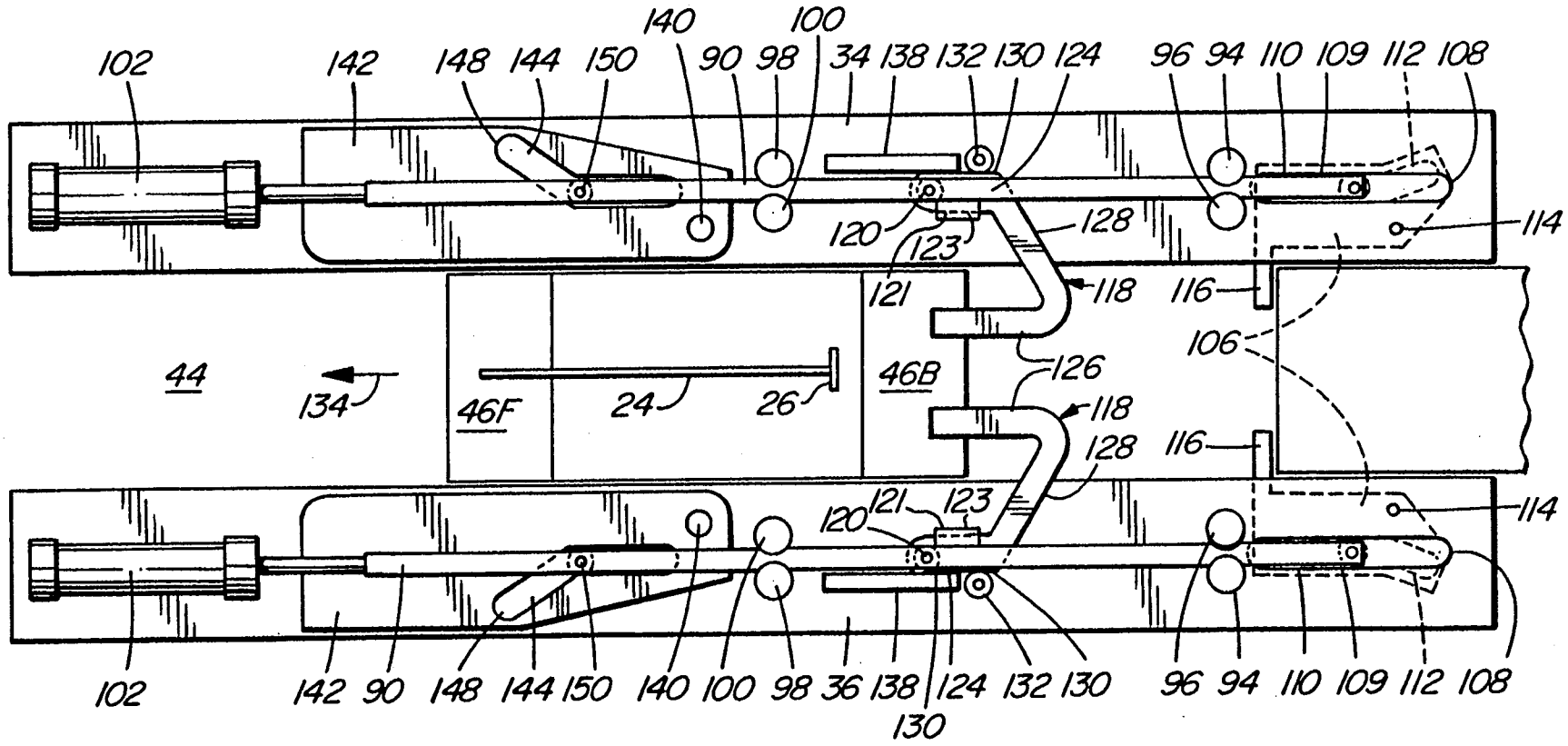

At the end of the longer arm 110 (downstream arm) is a stop flange 116 which is adapted to be projected into the passage 44 to obstruct movement of a carton 46A as indicated in FIG. 2B.

The cam slot 109 embraces the cam projection 104 on the control bar 90 so that the cam 104, cooperates with the arm section 112 of slot 109 to ensure that the stop flange 116 is in retracted position when the bar 90 is in the position shown in FIG. 2A (extreme right or upstream position) and then cooperates with arm section 110 as the bar 90 is moved to the left as shown in FIG. 2B to move the stop flange 116 into stopping position where it projects into the passage 44 and engages, as illustrated, the front wall of the next carton 46A to be closed. The stop lever 106 is maintained in this position by the cam 104 acting in the arm section 110 of slot 109 when the bar 90 is moved out of the upstream position.

Obviously, each stop lever 106 is pivotably mounted to and below its respective rail 34 or 36 on its pivot pin 114.

Mounted on each rod or bar 90 is a back flap folding hook 118. Each hook 118 is pivotably mounted as indicated at 120 at its forward end beneath the bar 90 so that the hook 118 may pass through the space 122 between the bar 90 and the upper surface of the rail 34 or 36 (see FIG. 1). The hook 118 is biased into the position (retracted position) shown in FIG. 2A by a suitable spring 121 or the like eg. coil spring 121 coiled around mounting pin 120 and biased between a shoulder (not indicated) on the hook 118 and the flange 123 fixed to the rod 90.

The hook 118 has a distorted U-shaped formed by a first arm 124 and a folding arm 126 interconnected by a bridging section 128.

Figure 2C:
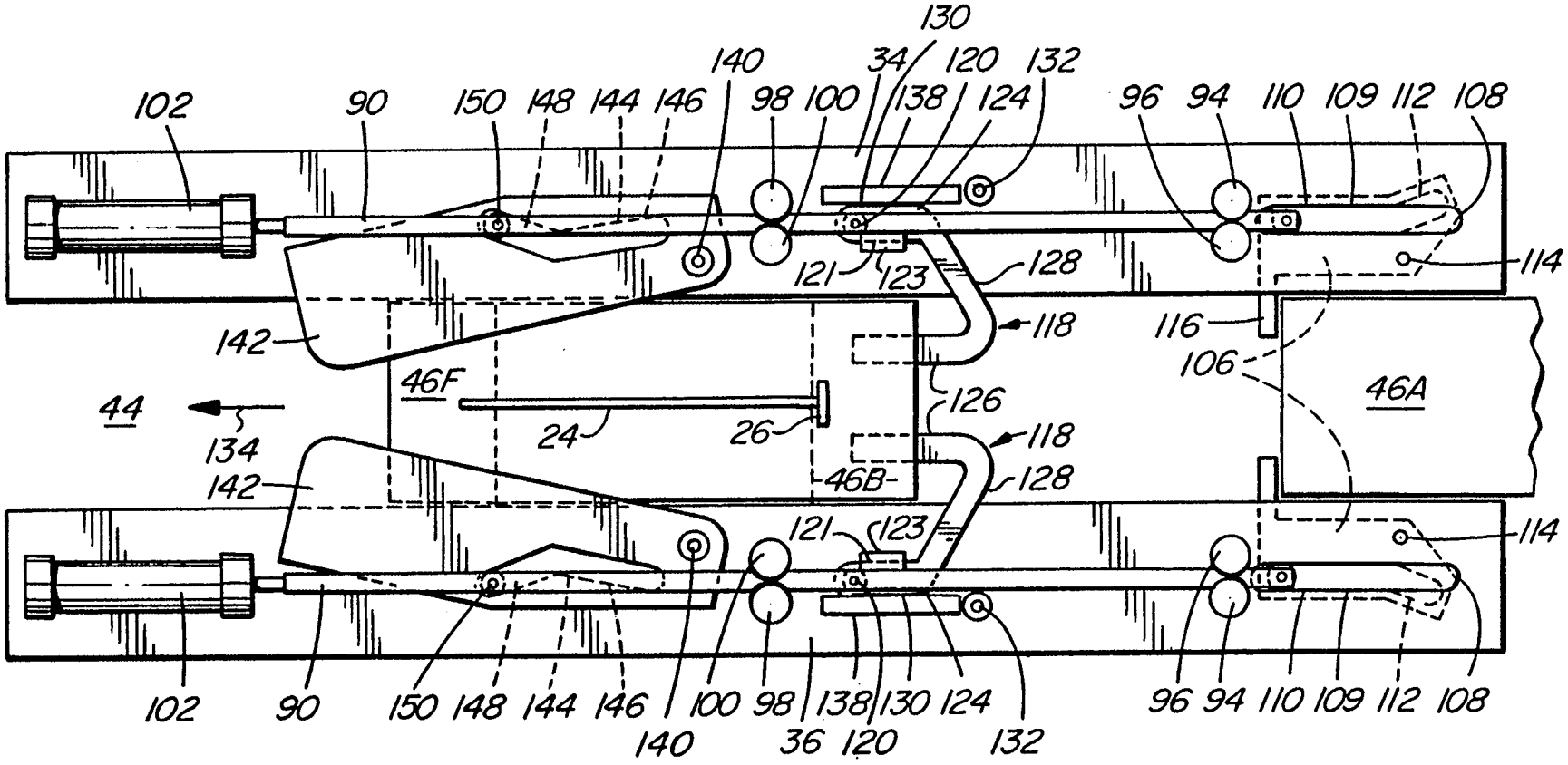

The leading (downstream) face 130 of the first arm 124 forms a cam that cooperates with a cam roller 132 mounted on the rail 34 or 36. The cam roller 132 engages a surface 130 as the bar 90 and hook 118 are moved to the left (in the downstream direction) in FIG. 2A as shown in FIGS. 2B and 2C to force the hook 118 into the carton passage 44. The swinging movement of the folding arm 126 into the passage 44 moves the arm 126 faster than the movement of the box 46 and thus the hook moves forward faster than the box and forces the back flap 46B into a folded position substantially perpendicular up to the back wall of the carton 46 (see FIG. 2B).

Movement of the bars 90 in the downstream direction i.e. direction of the arrows 134 is triggered by a sensor 115 that senses passage of the back end of the box 46 moving in the direction of the arrow 134.

As the bar 90 continues to move to the left in FIGS. 2A, 2B and 2C, the face 130 cooperates with the cam bar 138 or face of the bar 138 mounted on the rail 34 or 36 to hold the hook 118 in the projected position as shown in FIGS. 2A, 2B and 2C.

The front flap 46F is folded into a position perpendicular to the front wall of the carton 46 via the plough 26 shown in FIG. 1 by movement of the carton 46 along path 44 in the direction of the arrow 134.

Both the front and rear flaps 46F and 46B are folded perpendicular to their respective carton walls before the side flaps $46S_1$ and $46S_2$ (see FIG. 2C) are folded as will be described below.

Pivotably mounted on each of the rail 34 or 36 downstream of the cam roller 132 via a pivot 140 is a side flap plough 142 which is movable in the gap 122 between the bar 90 and the upper surface of its respective rail 34 or 36.

The plough 142 has its front end 144 guided by a grooved roller 146 and is bias to the position shown in FIG. 2A, in the illustrated arrangement via a spring 148 extending between the stop 150 and the pin 152 on the plough 142.

The plough 142 is provided with a cam slot 144 formed by a first slot portion 146 that extends substantially parallel to the direction of movement of rod 90 connected to a second slot portion 148 extending outward (away from the passage 44) at an angle from the downstream end of the slot portion 146. The cam slot 144 is adapted to cooperate with a roller cam 156 fixed to (beneath) the bar 90 to force the plough 142 into folding position wherein the plough 142 projects into the passage 44 (eg. as illustrated in FIG. 2C) as the bar 90 is moved in the downstream direction and holds the plough 142 in folding position when bar 90 reaches and remains in its most advanced position as shown in FIG. 2C. The ploughs 142 fold the two side flaps $46S_1$ and $46S_2$ into overlapping relationship with front flap 46F and rear flap 46B, but are only actuated, as above indicated, when the front and back flaps 46F and 46B have been folded.

If desired the position of the cam roller 150 on the bar 90 may be adjusted relative to the bar 90 to change the degree of extension of the ploughs 142 and thereby adjust to a limited degree the angle of the side flaps $46S_1$ and $46S_2$ after folding by the ploughs 142, eg. for adhesive application or the like.

It will be noted that in FIG. 2A locking elements 116 are in retracted position so that the carton 46 may pass into the passageway 44 and that in FIGS. 2B and 2C where the box 46 (Box #1) has advanced in the passageway 44 the flanges 116 are in projected position stopping the next box 46A which will only be released when the bars 90 are moved backward (upstream) to the position illustrated in FIG. 2A.

Figure 3:
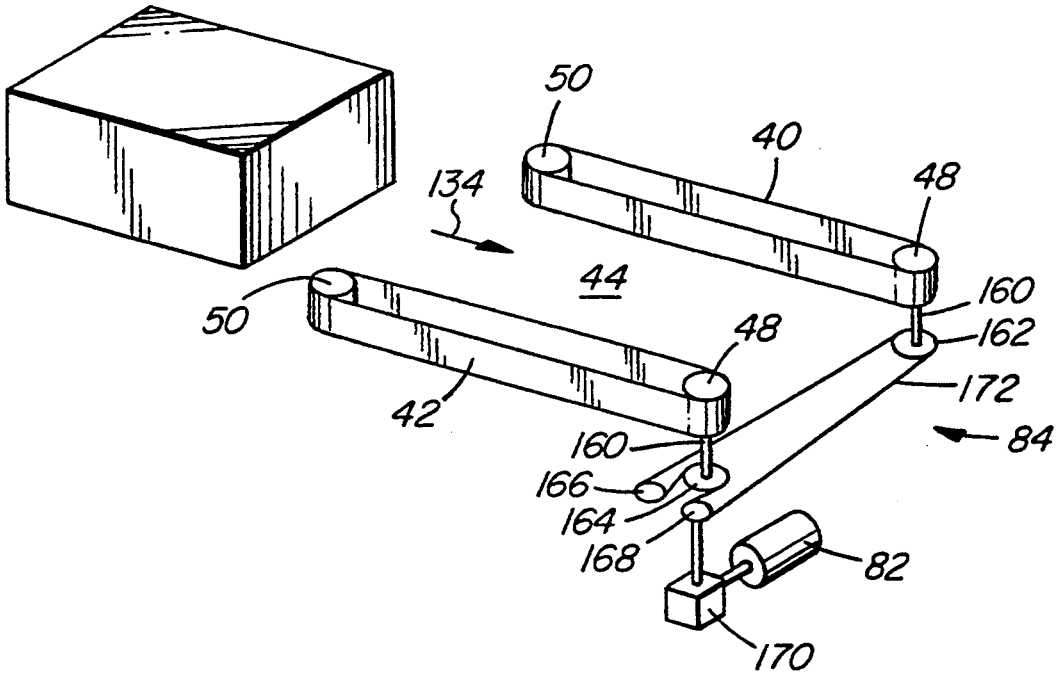
FIG. 3 is an isometric illustration of a drive system for the conveyor of the flap folder.

As shown schematically in FIG. 3, the belts 40 and 42 are driven by the drive drums 48 each of which are mounted on shaft 160 with the drive drum 48 for the belt 40 having a sprocket 162 and the drive drum 48 for the belt 42 having a sprocket 164 attached to its respective shaft 160.

The drive 84 includes idler sprocket 166 mounted on the frame 12 and a drive sprocket 168 also mounted on the frame 12 and which is driven via a speed reduction drive 170 from motor 82.

A drive chain 172 passes around the drive sprocket 168 to the sprocket driven 162, from the sprocket 162 to the idler sprocket 166 and then around the other driven sprocket 164 and back to the drive sprocket 168 and thereby assumes the shape of a pair of telescoped or nested U-shaped configurations.

Figure 4:
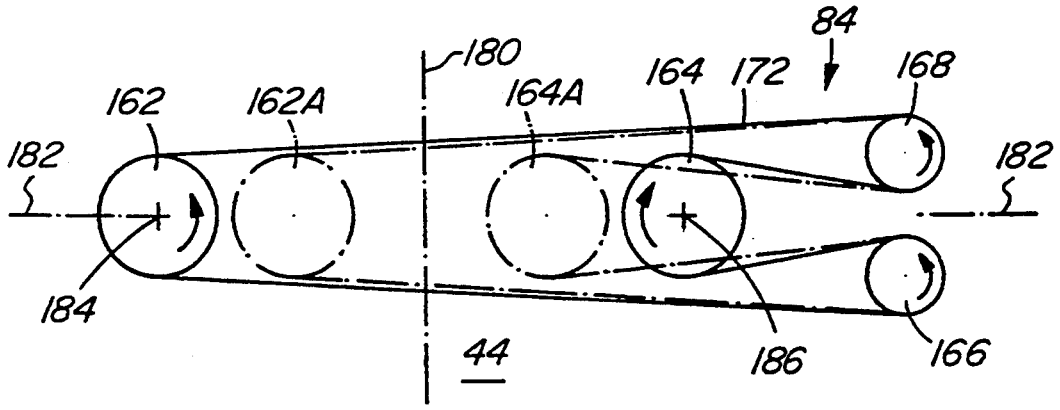
FIG. 4 is a plan view of the chain or belt drive of FIG. 3 showing the adjustment from the width of the passage.

As shown in FIG. 4, the sprockets 162 and 164 are symmetrically positioned on opposite sides of the centre line 180 of the passage 44 so that when the sprockets are moved from the 162A position to the 162 position and the 164A to the 164 position, the length of the chain need not be significantly adjusted yet the spacing of the belts 40 and 42 may be significantly changed. It will also be noted that in both positions, the wrap of the chain 172 around the sprockets 162 and 164 or 162A and 164A is over 180° thereby ensuring a good driving relationship with the chain 172. Also, it will be noted that both the sprockets 166 and 168 are wrapped more than 180° by the chain 172.

By positioning the two sprockets 166 and 168 adjacent one of the driven sprockets 164 at the side thereof remote from the other driven sprocket 162 and positioning the sprockets 166 and 168 one on each side of the line 182 interconnecting the axes 184 and 186 of the sprockets 162 and 164, the width required to accommodate the drive 84 does not require laterally extending the frame of the machine significantly beyond the widest spacing of the drive sprockets 162 and 164.

In operation the carton 46 starts in the same position as the carton 46A (Box #2) in FIG. 2B and is released as the bars 90 are moved to their extreme right hand position in FIG. 2A which moves the lever 106 to the retracted position shown in dotted lines in FIG. 2A and releases the box 46 to be engaged by the conveyors 40 and 42 and moved along the passage 44. When the rear end of the box 46 moving along passage 44 passes the sensor mounted on one of the rails 34 or 36 (or both depending on the type of sensor used), operation of the actuators 102 is triggered and the bars 90 are moved to the left (direction of the arrow 134) relatively quickly compared with the speed of movement of the box 46 along the passage 44.

Movement of the bars 90 as above indicated first moves via the cam 104 and slot 109 the stop levers 106 to extended position wherein the stop flanges 116 intercept the next box 46A and prevent it from entering the passage 44 and then moves via the cam roller 132 and cam face 130 the folding levers 118 to fold the rear flap 46B to a position substantially perpendicular to the rear wall of the box 46. As or in some cases before the flap 46B is folded the front flap 46F is folded perpendicular to the front wall of the box 46 by the shoe 26 (i.e. the box 46 is moved past the shoe 26). Preferably the folding of the front flap will occur as soon as practical i.e. the shoe 26 will be positioned as far to the right in FIG. 2A as practical so that the length of the machine may be kept to a minimum. The shoe 26 is shaped to permit folding of the side flaps 46$S_1$ and 46$S_2$ when the shoe 26 and support 24 overlie the box 46.

After the flaps 46B and 46F are folded a suitable hot melt or the like may be applied before the folding of the flaps 46$S_1$ and 46$S_2$ is completed by the ploughs 142 moved to folding position by the cooperation between the rollers 150 and cam slots 144 for example by applicators (not shown) mounted on the shoe 26 or its support 24.

The levers 118 travel faster to the left in FIG. 2A than the box 46 so that the levers 118 complete the folding of the flap 46B and then the ploughs 142 are actuated to move into the passage 44 and at least partially fold the flaps 46$S_1$ and 46$S_2$ over the flaps 46B and 46F.

After the flaps 46B, 46F, 46$S_1$ and 46$S_2$ have been folded as above described the conveyors 40 and 42 carry the box to the next station wherein folding of the flaps may (if not already done) be completed and the adhesive set or, for example, into a taping station (not shown) wherein the flaps 46B, 46F, 46$S_1$ and 46$S_2$ are taped closed.

The bars 90 are then moved by actuators 102 to their extreme right hand position shown in FIG. 2A either by timer (not shown) activation or by a sensor (not shown) sensing that the box 46 is clear so the next box 46A may be released.

Having described the invention, modifications will be evident to those skilled in the art without departing from the scope of the invention as defined in the appended claims.

I claim:

1. A flap folder comprising a pair of spaced parallel rails, a carton passage between said rails, a control bar mounted on each of said rails for axial movement relative to its respective rail, means for moving said bars in a first direction downstream of a direction of movement of a carton along said passage during a flap folding operation and then in a second direction opposite to said first direction, a pair of flap folding levers, each said flap folding lever having a first cam means, one of said flap folding levers being mounted on each of said bars, a pair of first cooperating cam means, one of said first cooperating cam means being fixed to each of said rails in a position to engage its adjacent said first cam means when said bars and said levers are moved in said first direction relative to said rails to move each of said levers from a retracted position to a flap folding position and maintain said levers in said folding positions during further movement of said bars in said first direction, and to return said levers to said retracted positions when said bars and said levers are moved relative to their respective said rails in said second direction opposite to said first direction.

2. A flap folder as defined in claim 1 further comprising a pair of ploughs, one of said ploughs pivotably mounted on each of said rails downstream relative to said lever in said first direction, a pair of second cams mounted one on each of said bars, a pair of second cooperating cam means, one of said second cooperating cam means mounted on each of said ploughs, each said second cam means being in a position to engage said second cooperating cam means on its adjacent said plough to move its adjacent said plough from a retracted to an extended folding position when said bars are moved in said first direction, but after said levers have moved to their said flap folding positions, and to permit said ploughs to return to said retracted positions when said bars are moved in said second direction.

3. A flap folder as defined in claim 2 further comprising a pair of stop levers, one of said stop levers pivotably mounted on each of said rails, a pair of third cam means one mounted on each of said bars, a pair of third cooperating cam means, one of said third cooperating cam means mounted on each of said stop levers, each said third cam means cooperating with its adjacent third cooperating cam means on its adjacent stop lever to move its adjacent stop lever to an extended position when its respective said bar is moved in the said first direction and maintain said stop lever in said extended position and to retract said stop lever when its respective said bar is moved in said second direction to the end of its path of travel in said second direction.

4. A flap folder as defined in claim 1 further comprising a pair of conveyors, one of said conveyors being on each side of said passage, means to drive said conveyors in synchronism to engage and move a carton along said passage in said first direction.

5. A flap folder as defined in claim 4 wherein said drive means comprise a driven wheel for driving each of said conveyors, a pair of guiding wheels mounted adjacent to one of said driven wheels on the side of said one of said driven wheels remote from the other of said driven wheels, a drive belt, means to drive said belt, said drive belt encircling said wheels to rotate said driven wheels in opposite directions when driven by said drive belt and wherein a line connecting the rotational axis of said driven wheels (or an extension whereof) passes between said pair of guiding wheels.

6. A flap folder as defined in claim 5 wherein said means to drive said belt includes one of said guiding wheels.

7. A flap folder as defined in claim 6 wherein said drive belt passes from one of said guiding wheels to said other of said driven wheels around the other said guide wheels then around said one of said driven wheels and to said one of said guide wheels.

8. A flap folder as defined in claim 7 wherein said belt means comprises a chain and said driven wheels and are guide wheels comprise sprockets.

9. A flap folder as defined in claim 2 further comprising a pair of conveyors, one of said conveyors being on each side of said passage, means to drive said conveyor in synchronism to engage and move a carton along said passage in said first direction.

10. A flap folder as defined in claim 9 wherein said drive means comprise a driven wheel for driving each of said conveyors, a pair of guiding wheels mounted adjacent to one of said driven wheels on the side of said one of said driven wheels remote from the other of said driven wheels, a drive belt, means to drive said belt, said drive belt encircling said wheels to rotate said driven wheels in opposite directions when driven by said drive belt and wherein a line connecting the rotational axis of said driven wheels (or an extension whereof) passes between said pair of guiding wheels.

11. A flap folder as defined in claim 10 wherein said means to drive said belt includes one of said guiding wheels.

12. A flap folder as defined in claim 11 wherein said drive belt passes from one of said guiding wheels to said other of said driven wheels around the other said guide wheels then around said one of said driven wheels and to said one of said guide wheels.

13. A flap folder as defined in claim 12 wherein said belt means comprises a chain and said driven wheels and guide wheels comprise sprockets.

14. A flap folder as defined in claim 3 further comprising a pair of conveyors, one of said conveyors being on each side of said passage, means to drive said conveyor in synchronism to engage and move a carton along said passage in said first direction.

15. A flap folder as defined in claim 14 wherein said drive means comprise a driven wheel for driving each of said conveyors, a pair of guiding wheels mounted adjacent to one of said driven wheels on the side of said one of said driven wheels remote from the other of said driven wheels, a drive belt, means to drive said belt, said drive belt encircling said wheels to rotate said driven wheels in opposite directions when driven by said drive belt and wherein a line connecting the rotational axis of said driven wheels (or an extension whereof) passes between said pair of guiding wheels.

16. A flap folder as defined in claim 15 wherein said means to drive said belt includes one of said guiding wheels.

17. A flap folder as defined in claim 16 wherein said drive belt passes from one of said guiding wheels to said other of said driven wheels around the other said guide wheels then around said one of said driven wheels and to said one of said guide wheels.

18. A flap folder as defined in claim 17 wherein said belt means comprises a chain and said driven wheels and guide wheels comprise sprockets.

* * * * *